US008454285B2

(12) United States Patent
Jackson et al.

(10) Patent No.: US 8,454,285 B2
(45) Date of Patent: Jun. 4, 2013

(54) LOAD SECURING SYSTEM

(75) Inventors: Mark Jackson, Goole (GB); Leigh Jowett, Sheffield (GB)

(73) Assignee: Loadhog Limited (GB)

( * ) Notice: Subject to any disclaimer, the term of this patent is extended or adjusted under 35 U.S.C. 154(b) by 0 days.

(21) Appl. No.: 13/057,345

(22) PCT Filed: Sep. 4, 2009

(86) PCT No.: PCT/GB2009/002125
§ 371 (c)(1),
(2), (4) Date: Mar. 8, 2011

(87) PCT Pub. No.: WO2010/029284
PCT Pub. Date: Mar. 18, 2010

(65) Prior Publication Data

US 2011/0158761 A1 Jun. 30, 2011

(30) Foreign Application Priority Data

Sep. 12, 2008 (GB) ..... 0816753.8
Dec. 24, 2008 (GB) ..... 0823516.0

(51) Int. Cl.
*B61D 45/00* (2006.01)

(52) U.S. Cl.
USPC ..... 410/96; 410/98

(58) Field of Classification Search
USPC ..... 410/96, 97, 98, 99, 100
See application file for complete search history.

(56) References Cited

U.S. PATENT DOCUMENTS

| | | | | | |
|---|---|---|---|---|---|
| 1,607,711 | A | * | 11/1926 | Walker | 217/69 |
| 3,312,181 | A | * | 4/1967 | Davidson | 410/97 |
| 3,478,394 | A | * | 11/1969 | Davis | 24/323 |
| 3,753,407 | A | * | 8/1973 | Tilseth | 108/53.3 |
| 3,759,416 | A | | 9/1973 | Constantine | |
| 4,042,111 | A | | 8/1977 | Smith | |
| 4,340,329 | A | * | 7/1982 | Ericsson | 410/101 |
| 4,416,374 | A | | 11/1983 | Smith et al. | |
| RE32,344 | E | * | 2/1987 | Wind | 206/599 |
| 4,801,024 | A | * | 1/1989 | Flum et al. | 211/59.4 |
| 4,848,580 | A | * | 7/1989 | Wise | 206/519 |
| 5,105,947 | A | * | 4/1992 | Wise | 206/519 |

(Continued)

FOREIGN PATENT DOCUMENTS

| | | |
|---|---|---|
| DE | 36 21 833 A1 | 1/1988 |
| DE | 10 2005 034 544 A1 | 1/2007 |

(Continued)

OTHER PUBLICATIONS

Great Britain Search Report which issued in connection with corresponding GB Patent No. GB0823516.0. on Apr. 20, 2009.

(Continued)

*Primary Examiner* — H Gutman
(74) *Attorney, Agent, or Firm* — Clark Hill PLC

(57) ABSTRACT

A load securing system comprises a tensioning member (18), and a securing member (22) on the tensioning member. First and second containers (12) can be arranged adjacent each other in an array of containers. Each of said first and second containers has a cooperating formation (28) to cooperate with the securing member. The tensioning member can extend across the containers to the aforesaid cooperating formations, and the securing member can be secured to the cooperating formations. The tensioning member can be tensioned to secure the first and second containers to each other.

19 Claims, 19 Drawing Sheets

U.S. PATENT DOCUMENTS

| | | | | |
|---|---|---|---|---|
| 5,111,938 | A * | 5/1992 | Soprano et al. | 206/386 |
| 5,224,635 | A * | 7/1993 | Wise | 222/608 |
| 5,722,328 | A * | 3/1998 | Darby | 108/55.1 |
| 5,765,707 | A | 6/1998 | Kenevan | |
| 5,967,322 | A * | 10/1999 | Apps et al. | 206/497 |
| 6,202,886 | B1 | 3/2001 | Schneider et al. | |
| 6,253,948 | B1 * | 7/2001 | Ficker | 220/350 |
| 6,367,630 | B1 * | 4/2002 | Elskamp | 206/508 |
| 6,821,068 | B2 * | 11/2004 | Facey et al. | 410/100 |
| 7,311,484 | B2 * | 12/2007 | Facey et al. | 410/100 |
| 7,476,069 | B2 * | 1/2009 | Facey et al. | 410/100 |
| 7,717,657 | B2 * | 5/2010 | Clarke | 410/98 |
| 2004/0101380 | A1 * | 5/2004 | Facey et al. | 410/100 |
| 2008/0019788 | A1 * | 1/2008 | Clarke | 410/98 |

FOREIGN PATENT DOCUMENTS

| | | | |
|---|---|---|---|
| GB | 2 130 180 | A | 5/1984 |
| GB | 2 363 598 | A | 1/2002 |
| GB | 2 363 599 | A | 1/2002 |
| GB | 2 402 380 | A | 12/2004 |
| JP | 2001-130687 | A1 | 5/2001 |
| WO | 96/37415 | A1 | 11/1996 |
| WO | 2006/024050 | A1 | 3/2006 |

OTHER PUBLICATIONS

Great Britain Combined Search and Examination Report which issued in connection with corresponding GB Patent Application No. GB1017906.7 on Nov. 11, 2010.

International Search Report which issued in connection with International Application No. PCT/GB2009/002125 on Jan. 20, 2010.

International Preliminary Report on Patentability which issued in connection with corresponding International Application No. PCT/GB2009/002125 on March 15, 2011.

* cited by examiner

LOAD SECURING SYSTEM

RELATED/PRIORITY APPLICATION

This application is a National Phase filing regarding International Application No. PCT/GB2009/002125, filed on Sep. 4, 2009, which relies upon Great Britain Application No. 0816753.8, filed on Sep. 12, 2008 and Great Britain Application No. 0823516.0, filed on Dec. 24, 2008 for priority.

This invention relates to load securing systems. This invention also relates to the use of load securing assemblies in load securing systems, and methods of securing loads. More particularly, but not exclusively, this invention relates to load securing systems for securing loads without pallets. Aspects of this invention relate to containers for use with such load securing systems.

During the storage of containers of goods, for example in warehouses, it is desirable to store the containers in stacks. In order to facilitate the loading and unloading of the containers relative to the stacks, the containers are arranged on pallets. Moreover, it is necessary to ensure that the containers are securely held together in stacks during transport. The use of pallets, particularly during transport, is considered essential to ensure that the stacks are held securely. For example, GB2363598 (Gripple Limited) and GB2402380A (Loadhog Limited) disclose caps for securing palletised loads. However, there is the problem that such arrangements for transporting loads are costly and troublesome.

According to one aspect of this invention, there is provided a load securing system comprising: a tensioning member, and a securing member on the tensioning member; first and second containers arrangeable adjacent each other in an array of containers, each of said first and second containers having a cooperating formation to cooperate with the securing member; wherein the tensioning member can extend across the containers to the aforesaid cooperating formations, and the securing member can be secured to the cooperating formations; and wherein the tensioning member can be tensioned to secure the first and second containers to each other.

According to another aspect of this invention, there is provided the use of a tensioning member in a load securing system, wherein a securing member is provided on the tensioning member; and the load securing system comprises: first and second containers arrangeable adjacent each other in an array of containers, each of said first and second containers having a cooperating formation to cooperate with the securing member; wherein the tensioning member can extend across the containers to the aforesaid cooperating formations, and the securing member can be secured to the cooperating formations; and wherein the tensioning member can be tensioned to secure the first and second containers to each other.

The load securing system may further comprise a securing assembly, and the securing assembly may include the tensioning member.

According to another aspect of this invention, there is provided a method of securing a load comprising: providing a tensioning member, and a securing member on the tensioning member; arranging first and second containers adjacent each other in an array of containers, each of said first and second containers having a cooperating formation to cooperate with the securing member; extending the tensioning member across the containers to the aforesaid cooperating formations and securing the securing member to the cooperating formations; and tensioning the tensioning member to secure the first and second containers to each other.

A securing assembly may be provided, and the securing assembly may include the tensioning member.

The securing assembly may comprise a tensioning device. Desirably, the tensioning member can extend from the tensioning device. The tensioning device is arrangeable on the array so that the tensioning member can extend from the tensioning device to the cooperating formations. The tensioning device may be operable to tension the tensioning member to secure the first and second containers to each other and to the securing assembly.

The tensioning member may comprise a flexible member, which may be an elongate flexible member.

Desirably, the load securing system does not include a pallet.

According to another aspect of this invention, there is provided a container for use in a load securing arrangement as described above, the container comprising a cooperating formation to cooperate with a securing member of a securing assembly, to secure the container to a load securing system.

Each container may comprise a main body. The cooperating formation may be a recess defined at or adjacent a side corner of the container. Desirably, the cooperating formation is defined at or adjacent a side corner of the main body.

The cooperating formation may be provided on the main body at a distance from the side corner that will allow the securing member to extend from the cooperating formation on the first container to the cooperating formation on the second container.

In one embodiment, the cooperating formation may be provided at a lower region of the main body. In this embodiment, the cooperating formation may be provided adjacent a lower edge of the main body. The main body may have a lower strengthening member at said lower edge of the main body, and the cooperating formation may be defined in the strengthening member.

In another embodiment, the cooperating formation may be provided at an upper region of the main body. In this embodiment, the cooperating formation may be provided adjacent an upper edge of the main body. The main body may have an upper strengthening member at said upper edge, and the cooperating formation may be defined in the upper strengthening member.

The cooperating formation may comprise an inclined formation, which may be generally straight. The cooperating formation may comprise an upper end and a lower end, the cooperating formation tapering upwardly from the lower end to the upper end. The cooperating formation may be arranged adjacent a side corner of the main body, and the cooperating formation may be inclined upwardly away from said side corner of the main body. The cooperating formation may comprise an engaging edge, which edge may be inclined upwardly towards an inner region of the main body.

A further edge may extend downwardly from the aforesaid engaging edge. An apex of the cooperating formation may be defined between the engaging edge and the further edge.

The method may comprise arranging the securing member to engage the inclined edges of the cooperating formations of adjacent containers. In one or more embodiments, this has the advantage of pulling the containers closer to each other when the tensioning member is tensioned, for example when a plurality of the first and second containers are nested one within another, but it will be appreciated that this can occur when a plurality of the first and second containers are stacked upon one another.

The cooperating formation may be an inverted V-shaped formation, which may be in the form of an inverted V-shaped recess. The method may comprise engaging the securing members in the inverted V-shaped recesses of the cooperating formations of the adjacent containers. In one embodiment, the securing member can engage the apex of the inverted V-shaped recess when a plurality of the first and second containers are stacked upon one another.

Each container may comprise a plurality of cooperating formations. At least one cooperating formation may be provided at each side corner of each container.

In one embodiment, each cooperating formation comprises an inner formation and an outer formation. The container may have a plurality of inner and outer formations. The inner and outer formations may be provided at side corner regions of the main body.

The inner formation may comprise an inclined edge, and may comprise an inner recess. The inner recess may comprise an inverted V-shaped recess. The outer formation may comprise an inclined edge, and may comprise an outer recess. The outer recess may comprise an inverted V-shaped recess.

The main body may comprise stabilising formations which can cooperate with the securing member to stabilise the securing assembly. The stabilising formations may be provided at a position between the side corners of the containers. The stabilising formations may comprise stabilising recesses, which may be inverted V-shaped recesses. In one embodiment, the stabilising formations may be provided at a lower region of the container.

Each container may comprise a plurality of support members extending downwardly from the main body to define spaces adjacent the support members beneath the main body. The spaces may be of a sufficient size to receive one or more lifting members of a lifting apparatus, for example the forks of a forklift truck, to allow the array of containers to be lifted.

In one embodiment, bearing members may extend between adjacent support members, wherein the aforesaid spaces are defined between the main body and the bearing members. Each bearing member may comprise a substantially flat strip.

Each of the support members may comprise a foot extending downwardly from the main body. Each support member may be of a substantially cuboid configuration. It will be appreciated that each support member can be of any suitable shape.

In one embodiment, the main body may comprise a base having a generally rectangular configuration, and a respective corner support member may be provided at each corner of the base. A respective intermediate support member may be provided in a central region of at least two lower edges, which may be opposite each other.

The support members may be spaced from each other by a distance sufficient to allow one or more lifting members to be inserted between them. Each lifting member may comprise a fork of a fork lift truck.

The main bodies of the containers may be nestable one within the other, and the containers may comprise a tilting arrangement to allow the container to be tilted relative to a further container arranged in a nesting relation therewith.

According to another aspect of this invention, there is provided a container having a main body configured to be arranged in a nesting relationship relative to the main body of a further similar container, and the container comprising a tilting arrangement to allow the container to be tilted relative to the further container.

The tilting arrangement may comprise a lip on the main body. The lip may have a curved portion to engage a further container arranged in a nesting relationship with the container.

The lip may extend downwardly and the curved portion may be convexly curved in a downward direction to engage an upper region of the container arranged in said nesting relationship therewith.

Conveniently, the securing member comprises a hook member having a pair of spaced hooks. The hooks may be spaced from each other by distance sufficient to span the gap between closely arranged cooperating formations of adjacent containers.

In one embodiment, the hook member may have an outer pair of hooks arranged to cooperate with inner cooperating formations on adjacent containers, and an inner pair of hooks arranged to cooperate with outer cooperating formations on adjacent containers.

According to another aspect of this invention, there is provided a hook member comprising an outer pair of hooks to engage first cooperating formations, and an inner pair of hooks to engage second cooperating formations.

The first cooperating formations may comprise inner cooperating formations on adjacent containers. The second cooperating formations may comprise outer cooperating formations on adjacent containers.

The inner pair of hooks may be arranged between the outer pair of hooks.

The outer pair of hooks may be spaced from each other by distance sufficient to span the gap between inner cooperating formations of adjacent containers. The inner pair of hooks may be spaced from each other by distance sufficient to span the gap between outer cooperating formations of adjacent containers.

The hook member may comprise a spacer member which can be inserted between adjacent containers when the hooks engage the cooperating formations.

The tensioning member may extend from the tensioning device downwardly over the containers. The method may comprise extending the tensioning member from the tensioning device to the cooperating formations.

In a first embodiment, the securing assembly may comprise a plurality of said tensioning members. In the first embodiment, the securing assembly may comprise a plurality of securing members. A respective securing member may be provided on the end of the, or each, tensioning member. The, or each, tensioning member may comprise a strap.

The securing assembly may comprise at least two of said tensioning members, and each tensioning member may be arranged to extend downwardly from a respective opposite edge of the securing assembly.

The securing assembly may comprise a plurality of tensioning devices, and a respective tensioning device may be provided for each tensioning member. If desired, a cap described in the UK patent specification number GB 2402380 can be used as the securing assembly described above. The disclosure of UK patent specification number GB 2402380 is incorporated herein by reference.

The, or each, tensioning device may comprise a winding member around which the tensioning member can be wound to tension the tensioning member. A lever may be provided to rotate the winding member and wind the tensioning member around the winding member. The lever may be pivotally movable to effect the aforesaid rotation of the winding member.

The securing assembly may comprise a housing for the, or each, tensioning device. The housing may comprises a cap for the array of containers, wherein the cap may be arranged on the array.

The housing may comprise downwardly extending side members which extend down over the containers when the securing assembly is arranged on the array of containers. The downwardly extending side members may comprise a depending skirt extending around the housing. The housing may be generally rectangular in configuration.

In one embodiment, the securing assembly may comprise a tensioning member on each side of the housing, and a corresponding securing member on each tensioning member. Thus, where the housing is rectangular in configuration, the securing assembly may comprise four of said tensioning members. However, it will be appreciated that the securing assembly may include any suitable number of tensioning members on each side.

The container may comprise further cooperating formations to co-operate with further securing members. The further cooperating formations may comprise receiving formations which may be recesses. The recesses may be inverted V-shaped recesses. The further cooperating formations may be provided along an edge of the container.

The further cooperating formations may be provided at intermediate support members, wherein the intermediate support members are arranged between support members at corners of the main body.

The aforesaid array of containers may comprise two or more containers. The array of containers may comprise a plurality of rows of containers, and each row may comprise two or more containers. Each container preferably comprises a lid. The containers in each row above the lower row may rest on the lid of a container in the row beneath. The lid may comprise features that allow the support members of the container above to tessellate therewith.

Embodiments of the invention will now be described by way of example only, with reference to the company drawings, in which.

Figure 1:
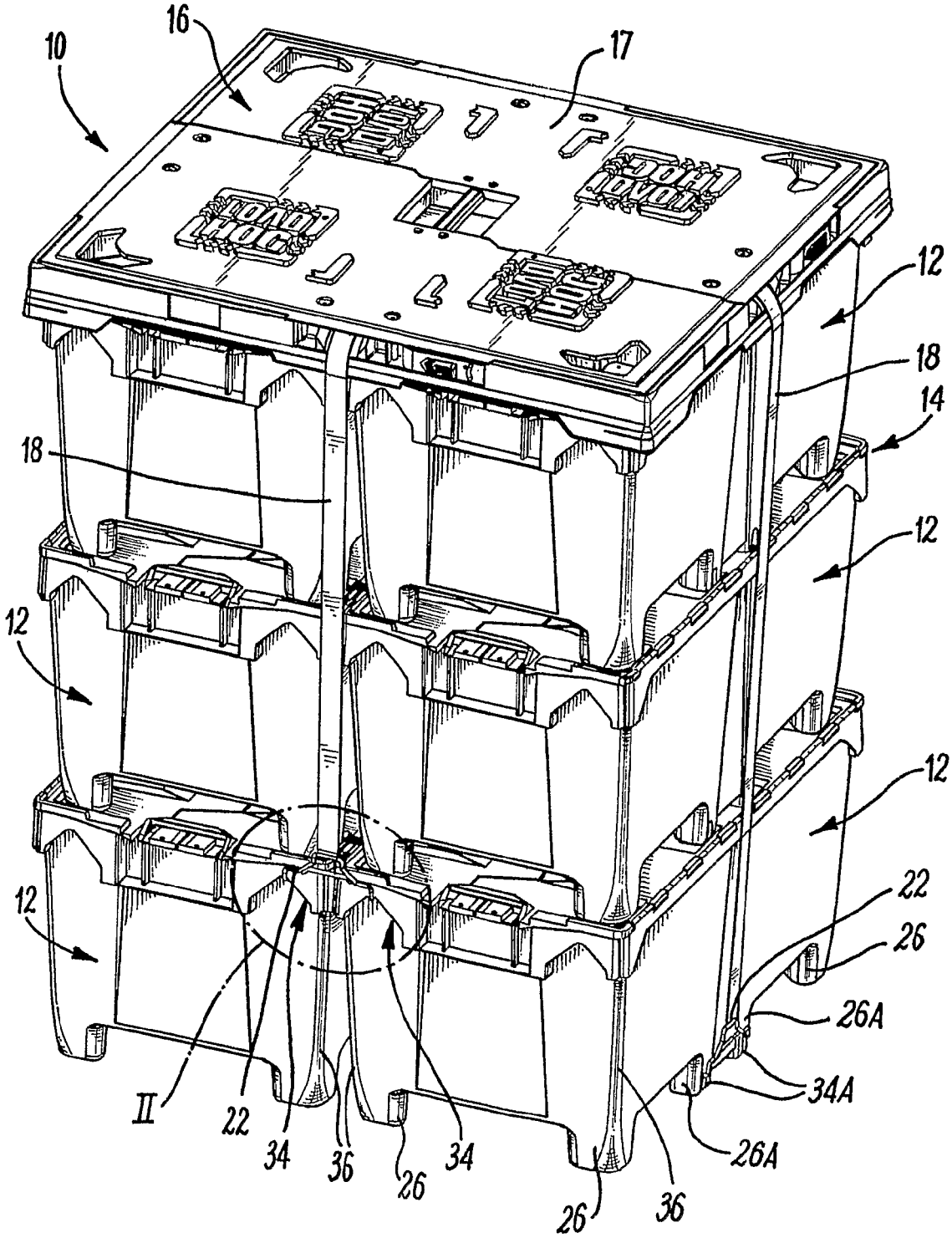
FIG. 1 is a perspective view of an embodiment of a load securing system with containers stacked upon one another.
Figure 2:
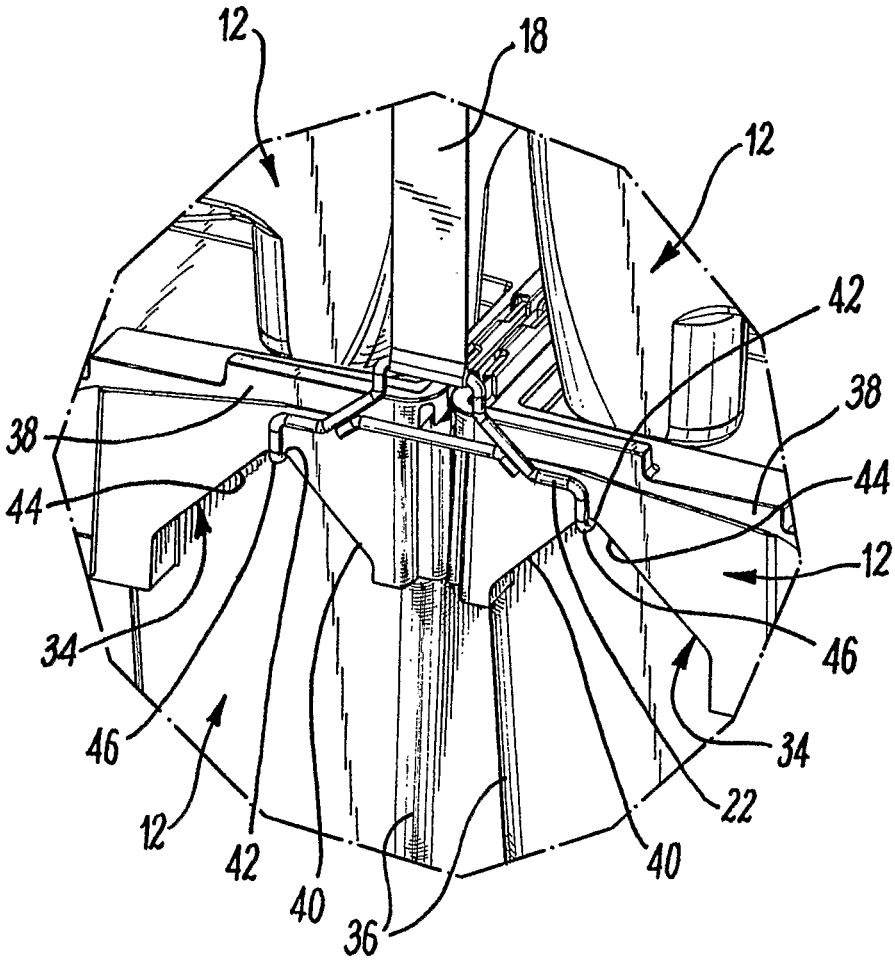
FIG. 2 is a close up view of the region marked II in FIG. 1.
Figure 3:
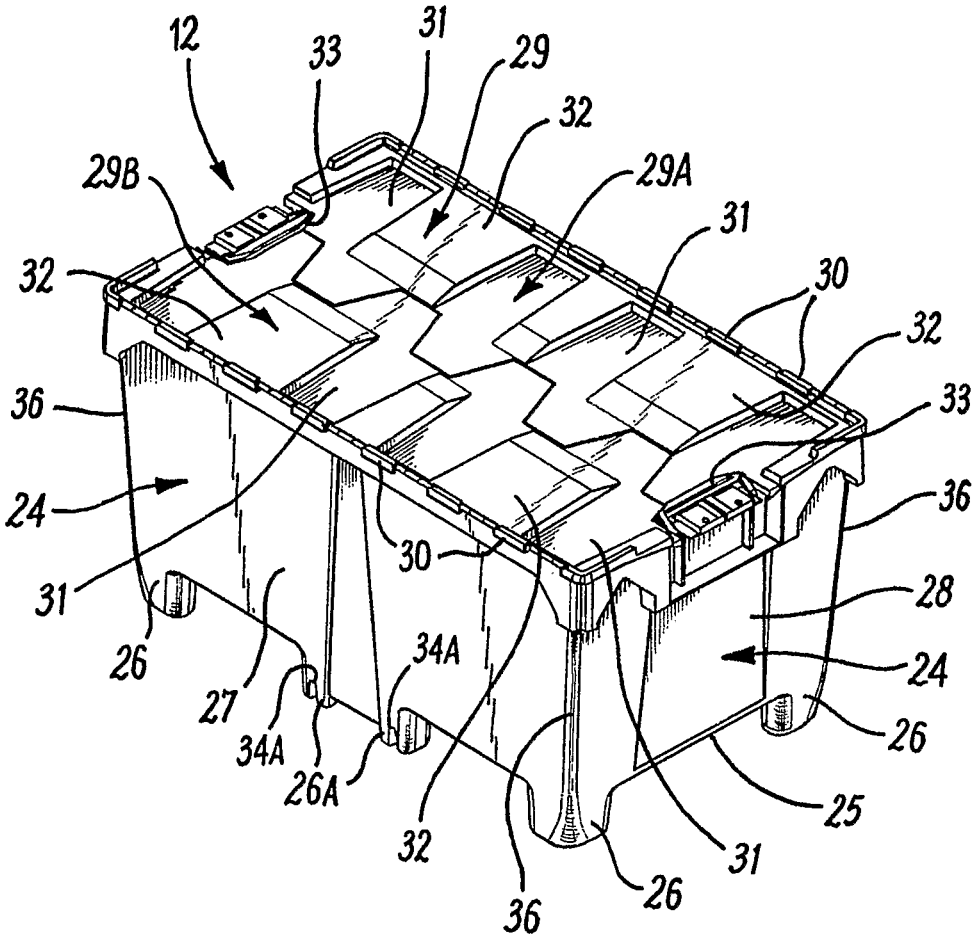
FIG. 3 shows a container with its lid in a closed position, for use with the load securing system shown in FIG. 1.

Referring to FIGS. 1 to 3, there is shown an embodiment of a load securing system, generally designated 10 which comprises a plurality of containers 12. The containers 12 have lids 29, which are in a closed position (see FIG. 3).

The containers 12 are stacked upon one another in a stack 14, so that the lids 29 of one container 12 support the container above. The stack 14 comprises two columns with each column having three containers, as shown. Each container 12 is arranged in an abutting relationship with the container adjacent thereto.

The securing system 10 further includes a securing assembly 16, in the form of a cap, which comprises a housing 17 and four tensioning members in the form of straps 18. The straps 18 extend from the housing 17 to the lowermost containers 12. The housing 17 has depending flanges 19 that, in use, extend downwardly over the upper region of the top most row of the containers 12

The securing assembly 16 is generally as described below. Only two of the straps 18 are shown in FIG. 1. The other two straps 18 are arranged opposite the straps 18 visible in FIG. 1 but are hidden from view by the stack 14 of the containers 12.

A securing member 22 is attached to the free end of each strap 18. The securing members 22 engage the lower most containers 12 and are described in more detail below with reference to FIG. 2.

Referring to FIG. 3, one of the containers 12 is shown with a lid 29 in a closed position so that the containers 12 can be stacked upon one another, as shown in FIG. 1. Each of the containers 12 comprises a main body 24 comprising two pairs of opposed upwardly extending walls 27 and 28. The walls 27 are attached to and extend transverse to the walls 28.

Each container 12 also includes four corner support members 26 in the form of feet, provided at the lower corners of the main body 24. Each container 12 shown in FIG. 1 also has two intermediate support members 26A provided at between the corner support members 26.

The lid 29 comprises two lid sections 29A, 29B, each being pivotally attached by hinges 30 to a respective one of a pair of opposite walls 27. Each lid section 29A and 29B defines a plurality of recesses 31 between raised portions 32. The purpose of the recesses 31 is to receive and hold the corner support members 26 of the container 12 stacked thereon. The lid 29 is held in its closed position, as shown in FIG. 3 by clips 33 pivotally attached to the walls 28.

The purpose of the corner support members 26 and the intermediate support members 26A is to raise the main body 24 to provide a gap underneath the main body 24 thereby allowing, for example, the forks of a forklift truck to be inserted under the main body 24 to enable the stack 14 of the containers 12 to be lifted.

Each of the containers 12 comprises cooperating formations in the form of inverted V-shaped recesses 34. The containers 12 have side corners 36 and upper edges 38. Each V-shaped recess 34 is provided adjacent the upper edge 38 and a respective side corner 36.

The V-shaped recesses 34 are shown more clearly in FIG. 2, which is a close up of the region marked XVIII in FIG. 1. Each V-shaped recess 34 comprises an engaging edge 40 inclined upwardly from the adjacent side corner 36. The engaging edge 40 extends to an apex 42 of the V-shaped recess 34. A further edge 44 extends downwardly from the apex 42 on the opposite side of the apex 42 to the engaging edge. 40. The further edge 44 is inclined downwardly away from the apex 42.

The hook member 22 comprises a pair of hooks 46 which are spaced from each other by a sufficient distance to engage in the apexes 42 of the V-shaped recesses 34 of the adjacent lowermost containers 12, when the lids 29 are in their closed positions, and the containers 12 are stacked on one another. In this arrangement, the straps 18 can be tensioned by the tensioning devices 16A to secure the containers 12 to one another, as described below with reference to FIG. 8.

The intermediate support members 26A define two stabilising recesses 34A on each of the opposite longer sides of the containers 12.

In the embodiment shown, the stabilising recesses 34A are defined at the intermediate support members 26A so that when one of the securing members 22 engages therein, and the respective strap 18 is tensioned, the securing assembly is stabilised on the stack 14 of the containers. In the embodiment shown a securing member 22 secured to the stabilising recesses 34A does not extend between adjacent containers 12.

The securing members 22 on two of the straps 18 engage in the stabilising recesses 34A of the adjacent lowermost containers 12 and, when tensioned by the tensioning devices 16A stabilise the containers 12 in the stack 14. The straps 18 secured to the stabilising recesses 34A also assist in securing the containers 12 to one another and help maintain the integrity of the stack 14.

Figure 4:
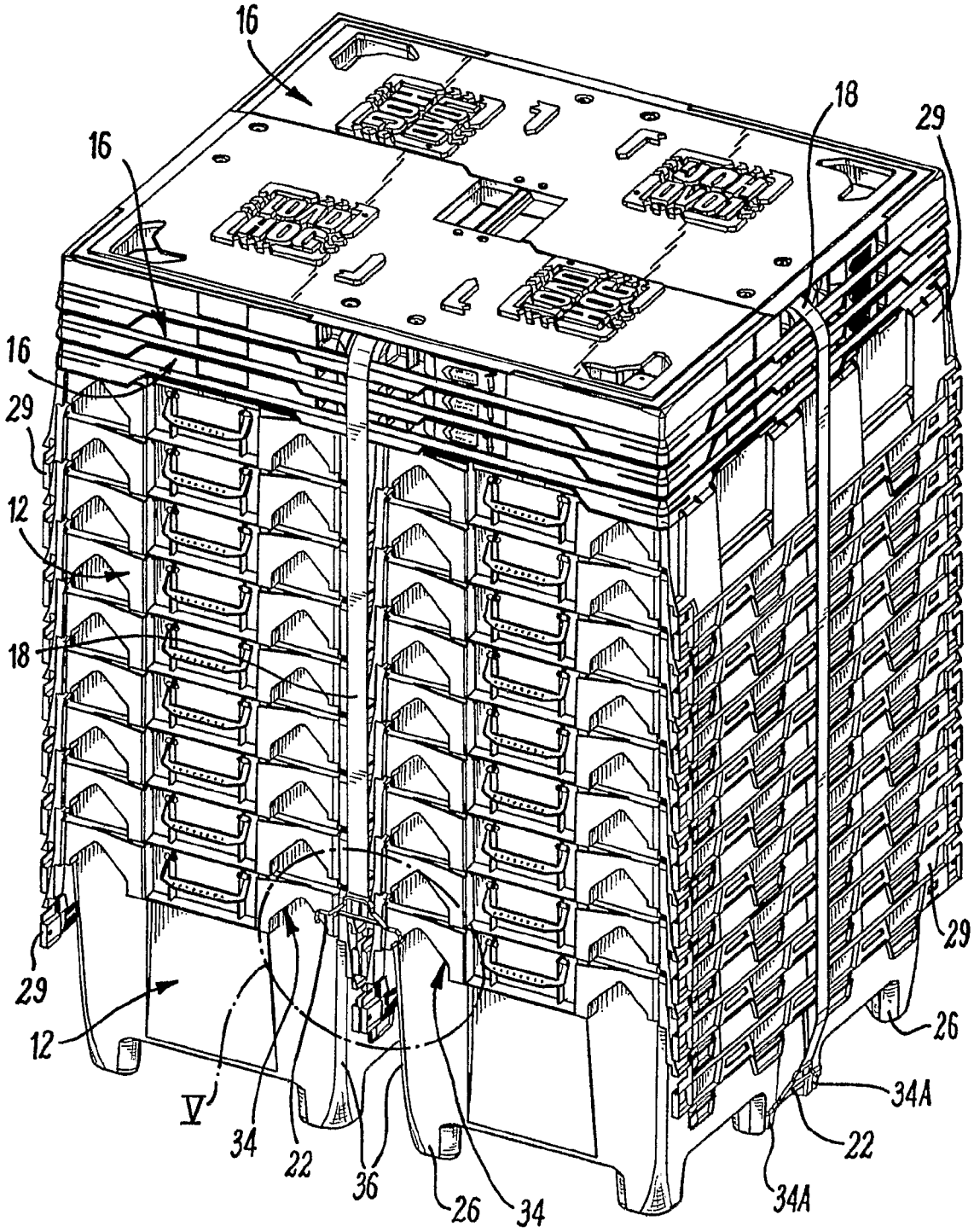
FIG. 4 is a perspective view of the embodiment of the load securing system shown in FIG. 1, but with the containers nested within one another.
Figure 5:
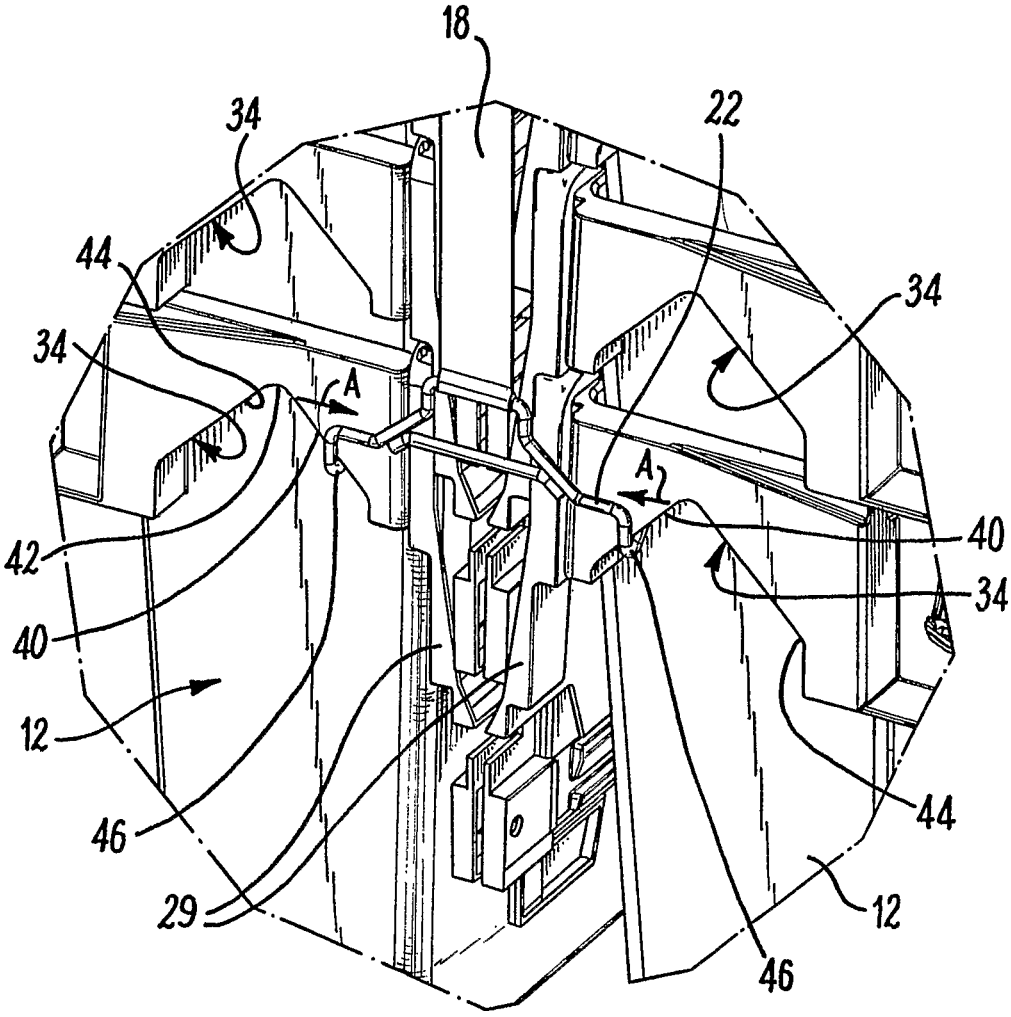
FIG. 5 is a close up view of the region marked V in FIG. 4.
Figure 6:
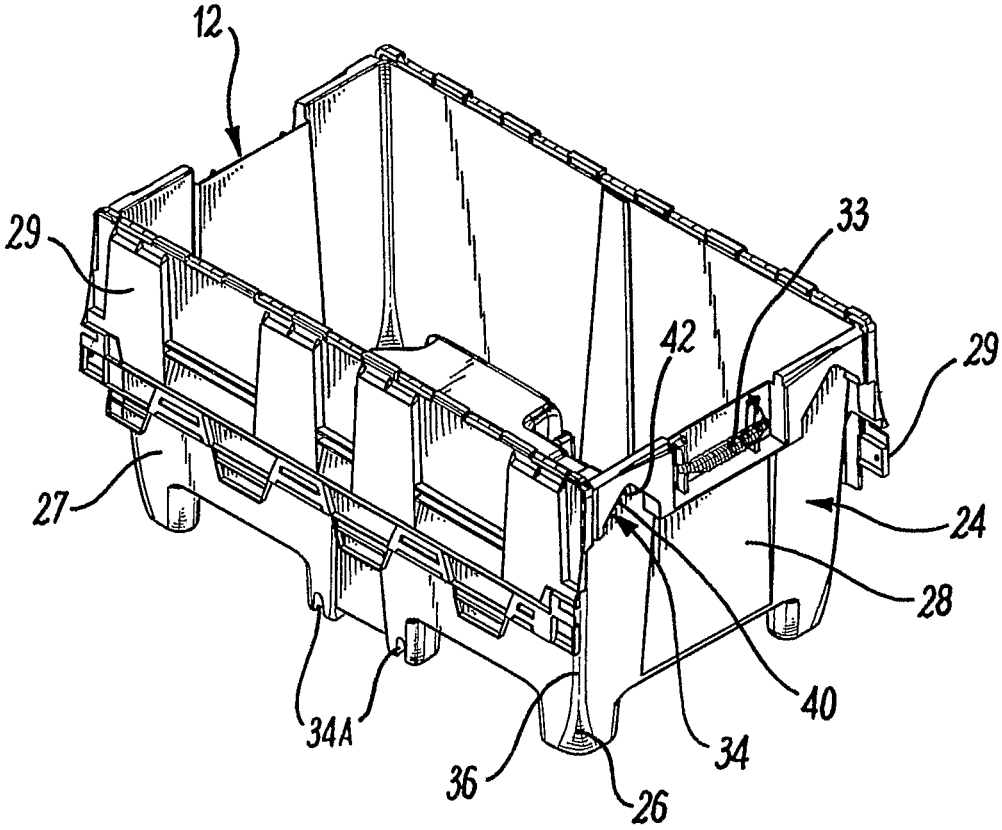
FIG. 6 shows a container with its lid in an open position, for use with the load securing system shown in FIG. 4.

FIGS. 4 to 6 show the load securing system 10 when the containers 12 are nested within one another, for storage purposes. In the arrangement shown in FIGS. 4 to 6, the lids 29 of the containers 12 are in their open position and the main bodies 24 are received within the main bodies 24 of the containers below.

As can be seen from FIG. 4, it is possible to secure more containers 12 to one another in a nested condition, than in a stacked condition. In FIGS. 1 to 3, it can be seen that six containers 12 are secured to one another in the stacked condition, whereas in FIG. 4 eighteen containers are secured to each other in the nested condition. Although FIGS. 1 and 4 show six and eighteen containers respectively, it will be appreciated that there could be any other suitable number of containers arranged on a stacked or nested condition.

Also, it is possible to store several securing assemblies 16 with the containers 12, when they are in their nested condition. The securing assemblies are arranged on top of the nested containers 12. In this arrangement, the straps 18 of the top most securing assembly 16 are used to secure the containers 12 and the securing assemblies 16 to one another.

When the lids 29 are in their open position, they hang down at the sides of the containers 12, as shown in FIG. 6. Thus, when the containers 12 are arranged next to each other, with the lids 29 in their open position, the V-shaped recesses are spaced further from each other relative to their positions as shown in FIG. 3. As a result, the hooks 46 engage the inclined engaging edges 40, and the force thereon by the strap 18 pulling the hook member 22 upwards, causes the containers 12 to be urged towards each other, as indicated by the arrows A in FIG. 5.

Figure 7:
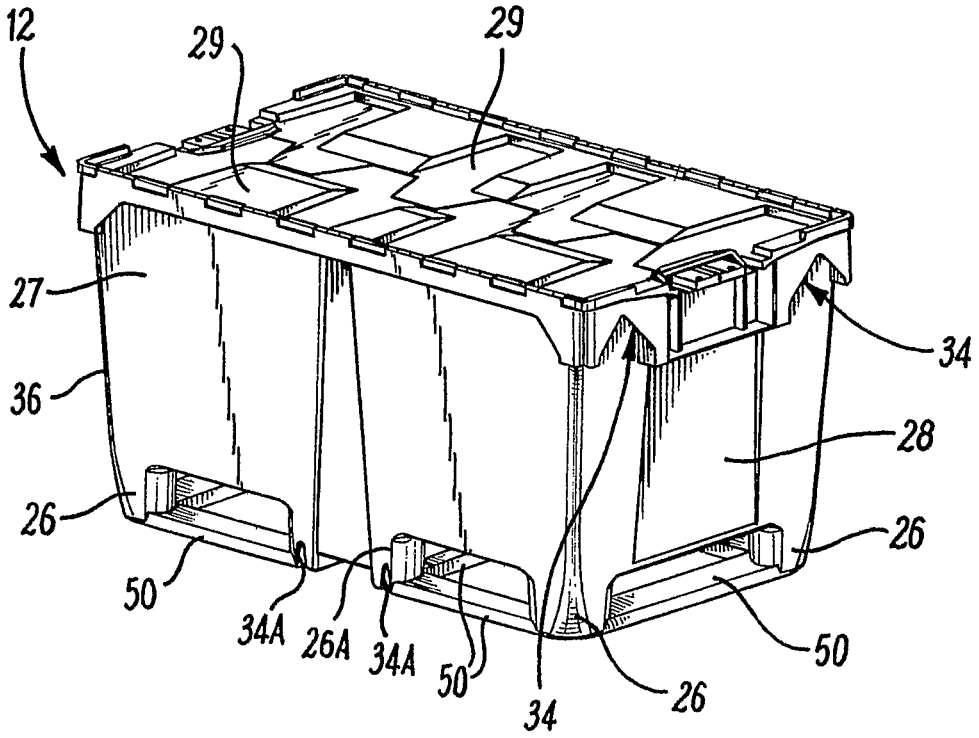
FIG. 7 shows a further embodiment of a container.

FIG. 7 shows a modification to the container 12, which possesses bearing members 50 that extend between the lower surfaces of the adjacent support members and intermediate support members 26, 26A.

The securing assembly 16 comprises four tensioning devices 16A (see FIG. 8) for tensioning the strap 18, there being a respective tensioning device 16A for each strap 18. The tensioning devices 16A are housed within the housing 17, and provide storage of the strap 18, when not in use.

A mechanism that is suitable for use as the tensioning device 16A is described and shown in UK patent specification GB 2402380, mentioned above. In GB 2402380, the tensioning device is referred to as a cassette.

The tensioning device 16A is described briefly below, with reference to FIG. 8.

Figure 8:
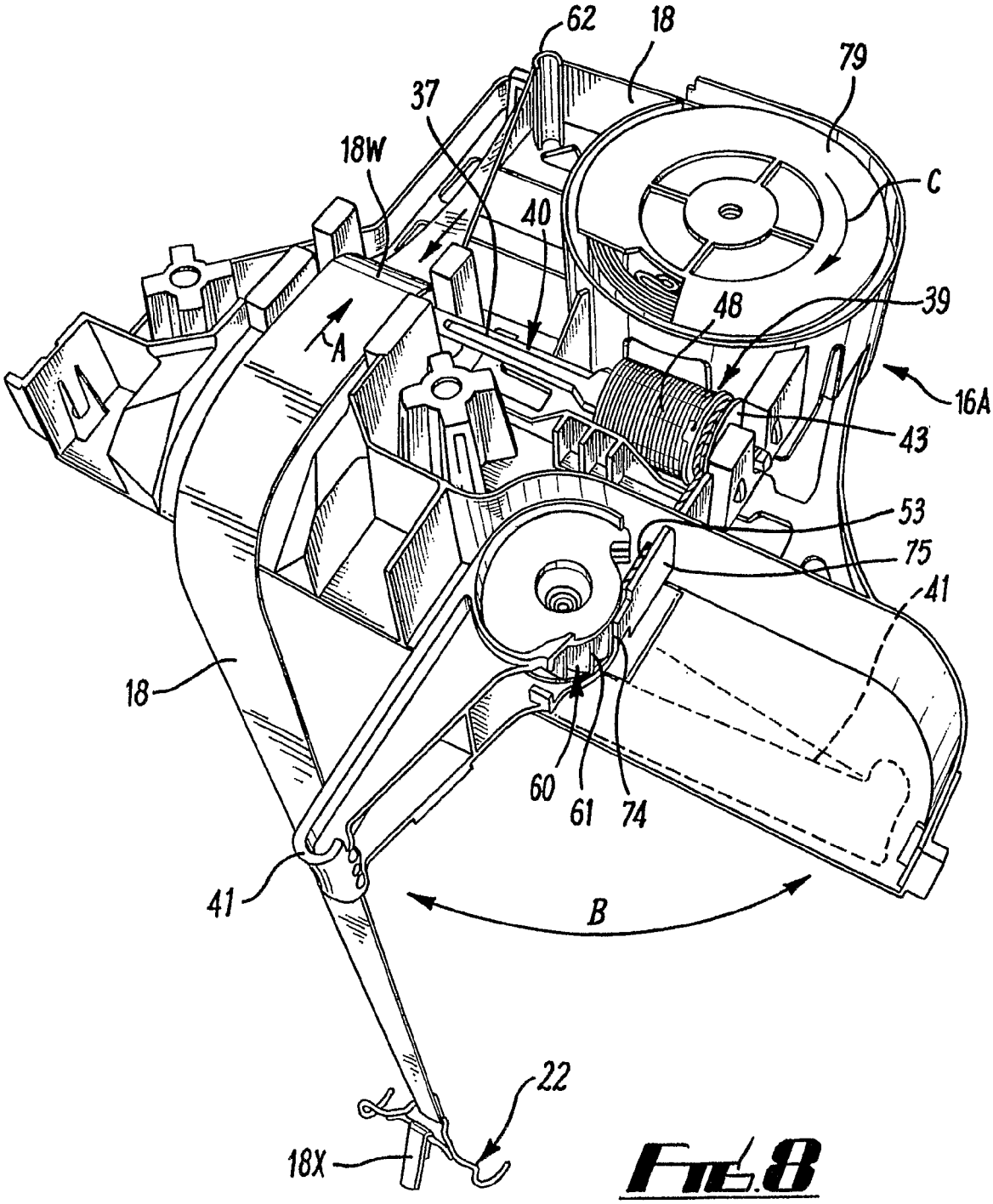
FIG. 8 is a close-up view of a tensioning device used in the load securing system shown in FIG. 1.

Referring to FIG. 8, the tensioning device 16A comprises tensioning means in the form of a cross bar 37 on one end of a spindle 40. The cross bar has an end region in which a slot (not shown) is defined. The strap 18 extends through the slot in the cross bar 37 to a strap storage mechanism which, in the embodiment shown, is in the form of a drum 79 upon which the strap 18 can be stored.

A linkage 39 operatively connects the cross bar 37 to a lever 41 which can be moved from an inoperative position (shown in broken lines in FIG. 8) to an operative position (shown in solid lines in FIG. 8). Moving the lever 41 from the inoperative position to the operative position causes rotation of the cross bar 37 about its longitudinal axis, to wind the strap about the slotted end of the cross bar 37, thereby tensioning the strap 18 by moving it in the direction indicated by the arrow A. The portion of the strap 18 so wound is designated 18W in FIG. 8.

The end of the cross bar 37 spaced from the slotted end is provided with a pulley 43 around which is wound a wire rope 53. The wire rope 53 extends to a ratchet arrangement 60 provided on the lever 41. The ratchet arrangement 60 has a fixed condition, and is held in the fixed condition by a holding pawl (not shown) in the lever 41. In the fixed condition, the ratchet arrangement rotates with the lever 41 when the lever 41 is rotated from the inoperative position to the operative position. The ratchet arrangement also has a released condition, in which the ratchet arrangement is released from the lever 41 to allow the lever 41 to rotate freely relative to the ratchet arrangement 60 when the lever 41 is moved from the operative position to the inoperative position The wire rope 53 is attached to the ratchet arrangement 60, so that when the lever 41 is moved to the operative position, the ratchet arrangement is rotated therewith. Thus, the wire rope 53 is unwound from the pulley 43, thereby rotating the pulley 43 and the cross bar 37 in a first direction, and winding the strap 18 onto the slotted end of the cross bar 37.

When the lever 41 is returned to the inoperative position, the ratchet arrangement 60 does not rotate, thereby allowing the lever 41 to be again moved to the operative position, to further rotate the ratchet arrangement 60 and further wind the strap 18 around the slotted end region of the cross bar 37.

The oscillation of the lever 41 between the operative and inoperative conditions, as shown by the double headed arrow B, allows the strap 18 to be wound upon the slotted end of the cross bar 37 until sufficient tension has been achieved in the strap 18.

A spring 48 is provided on the cross bar 37 to urge the cross bar 37 to rotate in a second direction opposite to the first direction, to wind the wire rope onto the pulley 43.

The ratchet arrangement 60 comprises teeth 61 which can be engaged by a latching pawl 74 on a resilient arm 75. The latching pawl 74 prevents rotation of the ratchet arrangement 60 with the lever 41 when the lever 41 returns to its inoperative position.

The strap extends from the slotted end of the cross bar 37 to a vertical post 62, which twists the strap 18 through 90°, so that the strap 18 can be wound onto the drum 79. A spring (not shown) is mounted on the drum 79 to urge the drum in the direction indicated by the arrow C, to wind the strap 18 onto the drum 79.

As can be seen from FIG. 8, the strap 18 carries one of the hook members 22, but the hook member 22 shown in FIG. 8 is of a slightly different design to the hook member 22 shown in FIGS. 1 to 5, but functions in exactly the same way.

The hook member 22 shown in FIG. 8 has a tab 18X attached thereto which allows the strap 18 to be easily pulled from the securing device 16, and the hook member 22 secured in place.

A release arrangement (not shown) is provided to release the wire rope 53 and allow it to be wound back onto the pulley 43, thereby releasing the tension in the strap 18 so that the hook member 22 can be released from the cooperating formations with which it is engaged.

Various modifications can be made without departing from the scope of the invention. For example, the V-shaped recesses and the stabilising recesses are all provided at a lower region of the container, as described below.

Referring to FIGS. 9 to 13, there is shown a load securing system 110 comprising a plurality of containers 112 arranged in an array in the form of a stack 114 of the containers 112. As can be seen from FIG. 9, the stack 114 of the containers 112 comprises three rows of the containers 112, wherein each row of the containers 112 consists of two of the containers 112 arranged adjacent each other in an abutting relationship.

The securing system 110 also comprises a securing assembly 16 in the form of a cap arranged on the top of the stack 114 of the containers 112, each having a generally rectangular profile in top plan view, with one pair of opposite sides being longer than the other pair of opposite sides. The securing assembly 16 comprises a housing 17 and four tensioning members in the form of straps 18. As can be seen from FIG. 9, the straps 18 extend from the housing 17 to the bottom of the stack 114 of the containers 112.

The housing 17 has depending flanges 19 that, in use, extend downwardly over the upper region of the top most row of the containers 112 in the stack 114, thereby securely holding the containers 112 to one another in the stack 114.

Figure 9:
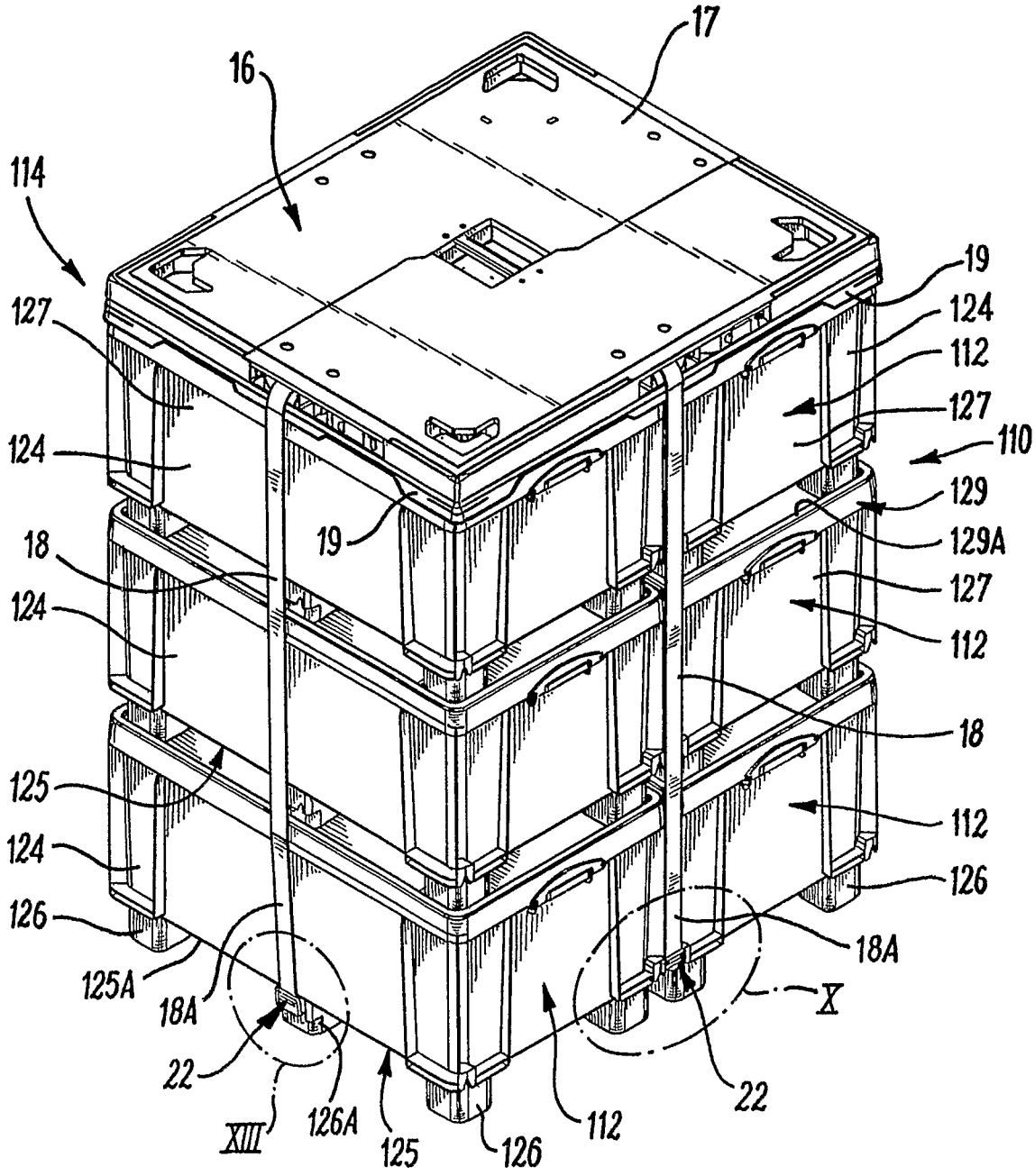
FIG. 9 is a perspective view of a further embodiment of a load securing system with containers stacked upon one another.

Only two of the straps 18 are shown in FIG. 9. The other two straps 18 are arranged opposite the straps 18 visible in FIG. 9 but are hidden from view by the stack 114 of the containers 112.

The securing assembly 16 comprises four tensioning arrangements 16A arranged within the housing 17. The tensioning arrangements 16A are not visible in FIG. 9 but are shown in FIG. 8, and described above.

Each of the straps 18 has a free end 18A, at which a respective securing member 22 is provided. Each securing member 22 engages the lower most containers 112 and is described in more detail below with reference to FIG. 10.

Each of the containers 112 comprises a main body 124 of a generally rectangular configuration, in which items can be held for storage or transport. The main body has a base member 125 to support the items therein, and upwardly extending walls 127 on the edges of the base member 125. A lid 129 is provided on the main body 124 of each container 112. Each lid 129 has a raised rim 129A to prevent a container resting thereon from sliding off.

Each container 112 also includes four corner support members 126 in the form of cuboid feet, provided at the corners of the base member 125. Each container 112 shown in FIG. 9 also has two intermediate support members 126A provided at an intermediate region of the longer edges 125A of the rectangular base member 125. If desired, the intermediate support members 126A can be of a different size and/or shape to the corner support members 126 or, alternatively, they can be identical.

The purpose of the corner support members 126 and the intermediate support members 126A is to raise the main body 124 to provide a gap underneath the main body 124 thereby allowing, for example, the forks of a forklift truck to be inserted under the main body 124 to enable the stack 114 of the containers 112 to be lifted.

Figure 10:
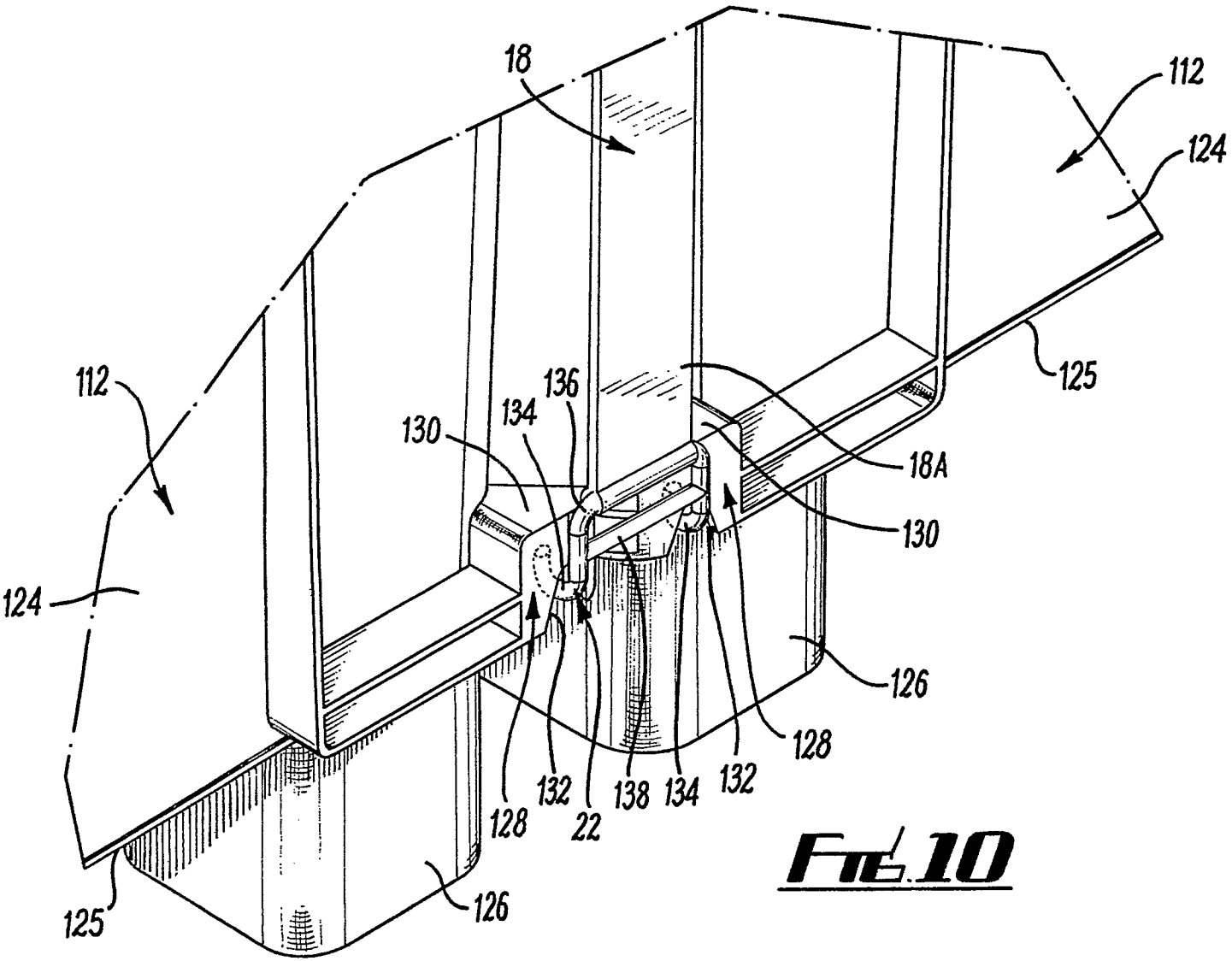
FIG. 10 is a close-up view of the region marked X in FIG. 9.
Figure 12:
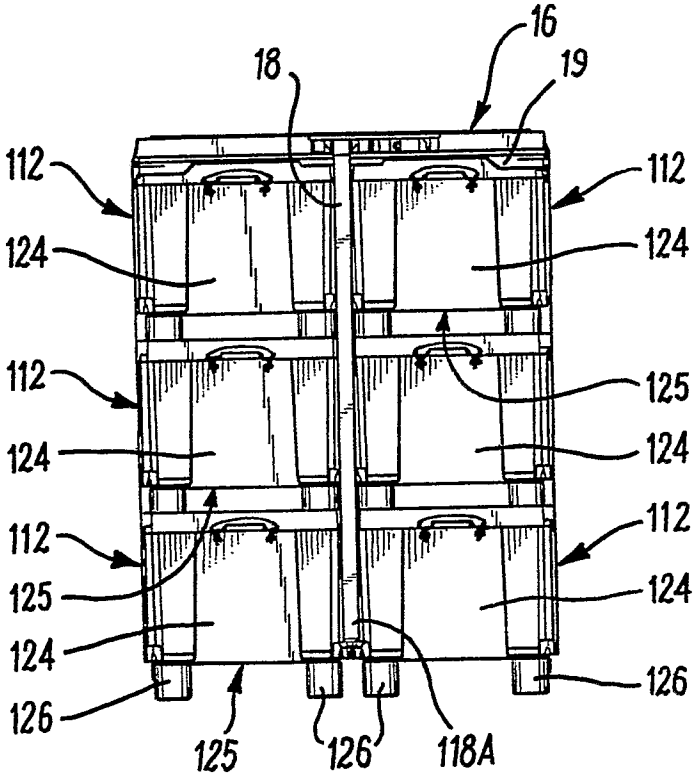
FIG. 12 is the front view of the load securing system shown in FIG. 9.
Figure 11:
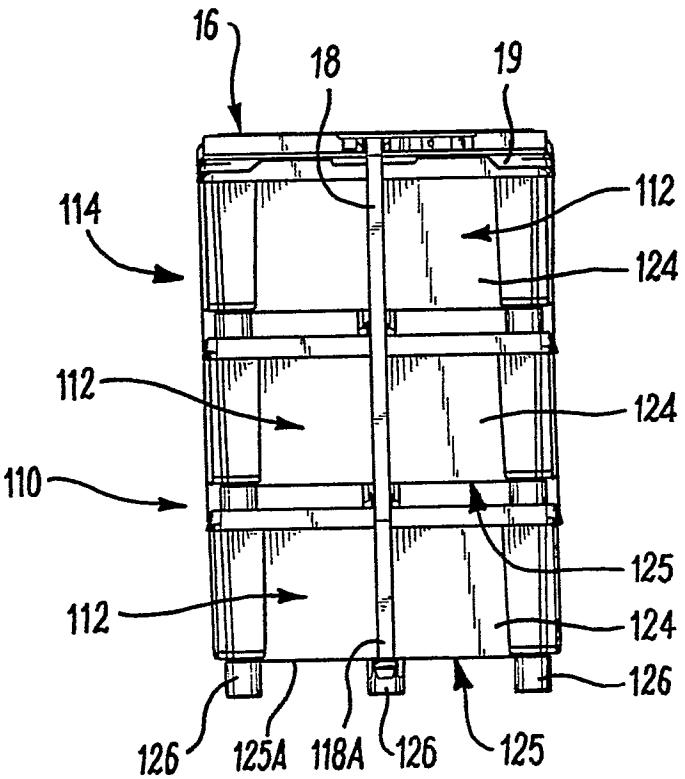
FIG. 11 is a side view of the load securing system shown in FIG. 9.

FIG. 10 shows the region marked II in FIG. 9, in which adjacent containers 112 abut each other. Each of the containers 112 is provided with cooperating formations 128 at the corners of the base member 125. The cooperating formations 128 shown in FIG. 10 are adjacent to, and closely spaced from, each other.

As can be seen from FIG. 10, each securing member 22 comprises a pair of spaced hook members 134, which are connected to each other by upper and lower bridging portions 136, 138, wherein the strap 18 is secured to the upper bridging portion 136.

Each cooperating formation 128 comprises a projecting element 130 which extends outwardly from the main body 124. Each projecting element 130 defines an inverted V-shaped recess 132 to cooperate with the securing member 122.

Each of the hook members 134 is received in the inverted V-shaped recess 132 of a respective one of the adjacent cooperating formations 128. Thus, the first securing members 22 secure the adjacent containers 112 to each other and secure the securing assembly 16 on the stack 114.

Figure 13:
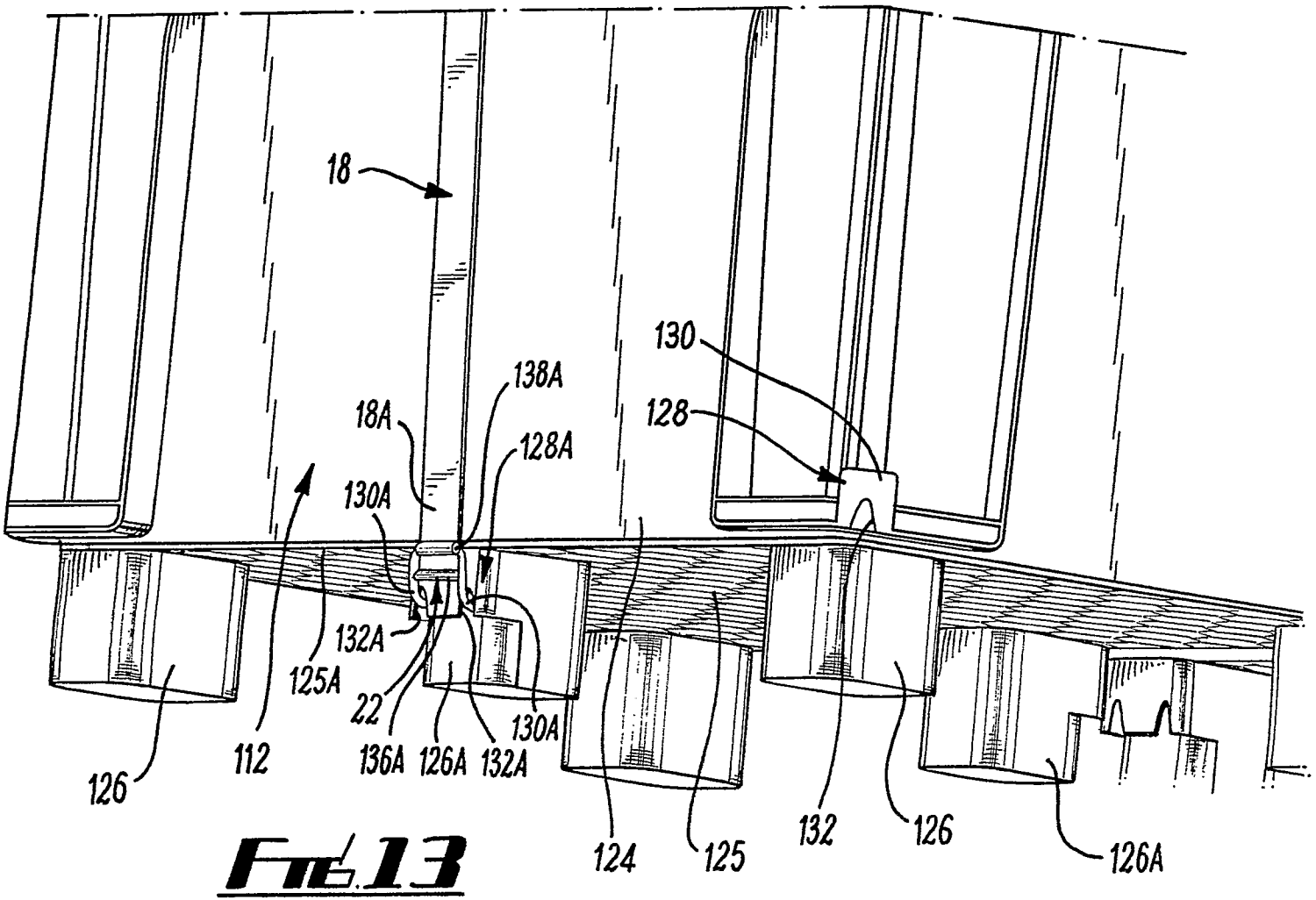
FIG. 13 is a bottom perspective view of the region marked XIII in FIG. 9.

Referring to FIG. 13, there is shown a bottom perspective view of the region marked V in FIG. 9. FIG. 13 shows one the intermediate support members 126A, arranged centrally on the longer edge 125A of the base 125. Each of the intermediate support members 126A is provided with a further cooperating formation 128A in which are defined a pair of stabilising recesses 132A.

In the embodiment shown, the stabilising recesses 132A are defined generally centrally of the longer edge 125A, so that when one of the securing members 22 engages therein, and the respective strap 18 is tensioned, the securing assembly is stabilised on the stack 114 of the containers. A securing member 22 secured to the stabilising recesses 132A does not extend between adjacent containers 112.

One of the securing members 22, provided at the end region 18A of the strap 18, shown in FIG. 13, engages in the stabilising recesses 132A on the intermediate support member 126A.

The inverted V-shaped recesses 132A can receive the hook members 134 thereby further securing the containers 112 to each other, and securing the securing assembly 16 to the stack 114.

Figure 14:
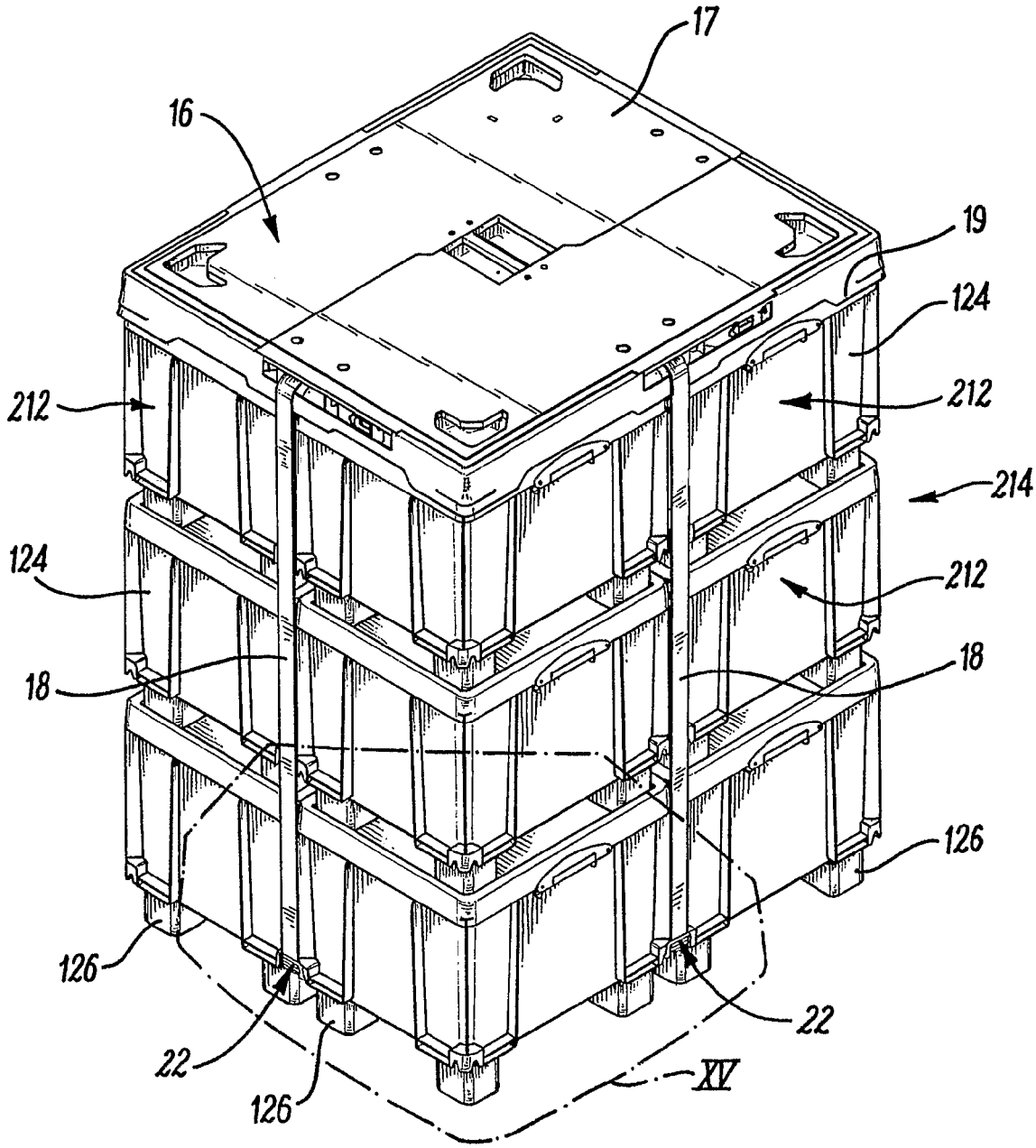
FIG. 14 is a perspective view of a variation of the embodiment of the load securing system shown in FIG. 9.
Figure 15:
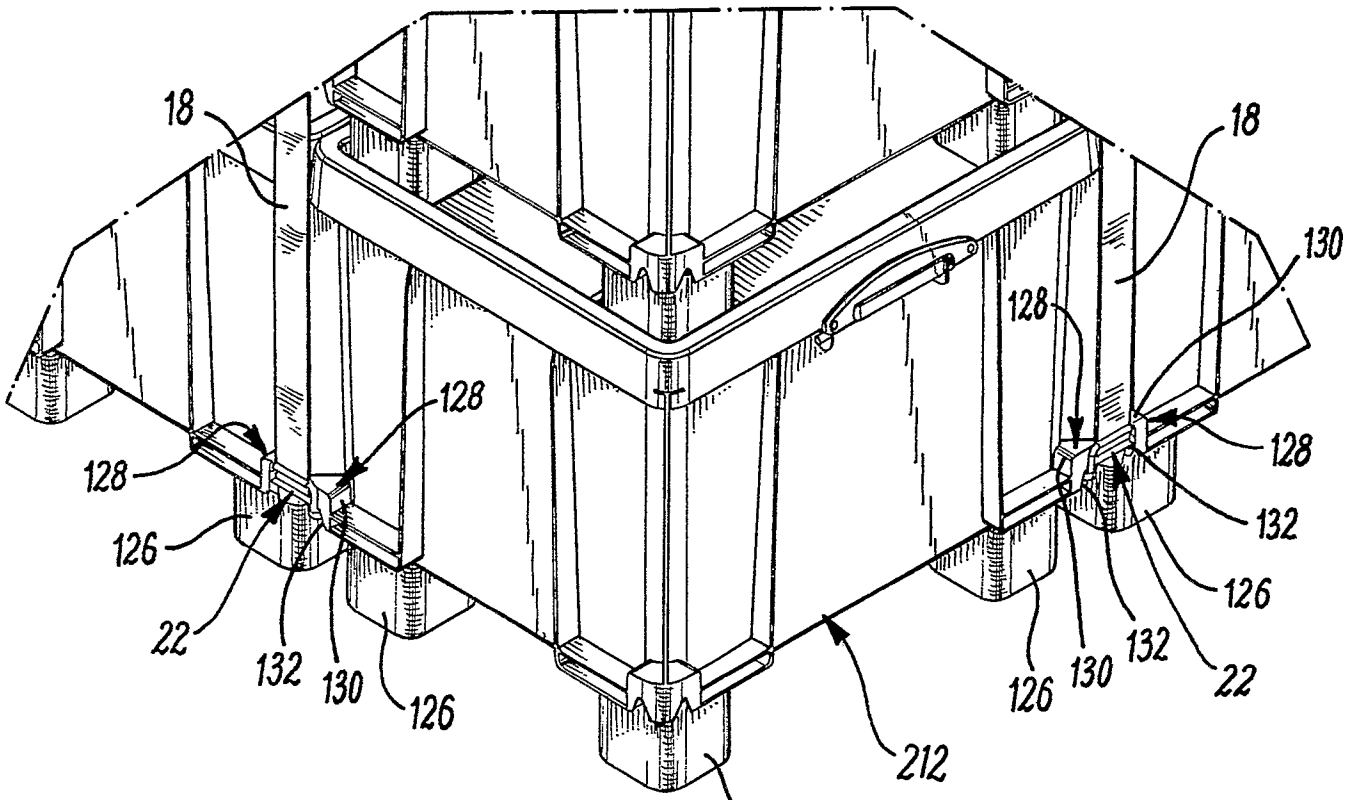
FIG. 15 is a close-up of the region marked XV in FIG. 14.

In a further modification, the number and size of the containers in the stack can vary. FIGS. 14 and 15 show a variation of the containers 112 shown in FIGS. 9 to 13. In FIGS. 14 and 15, there is shown a stack 214, which comprises a plurality of containers 212, which are similar to the containers 112 but all the sides are substantially the same size, so that the containers 212 are of a generally square profile in top plan view.

As can be seen from FIGS. 14 and 15, there are four containers 212 in each row of the stack 214. Each container 212 has only four corner support members 126, and does not possess the intermediate support members 126A. Each of the straps securing members 22 on all four of the straps 18 engages a pair of adjacent cooperating formations 128 on adjacent containers 212.

Figure 16:
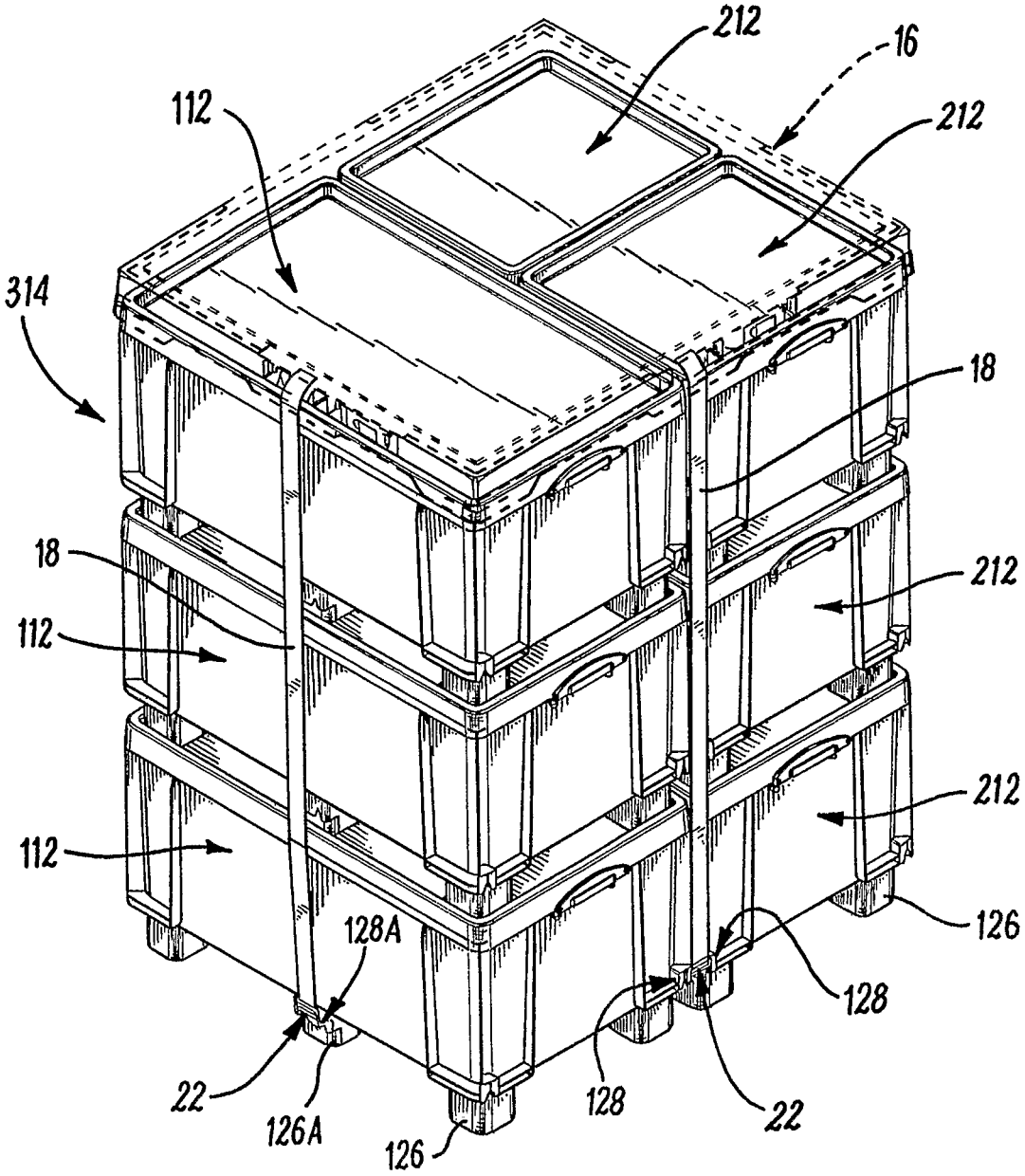
FIG. 16 is a perspective view of another variation of the embodiment of the load securing system shown in FIG. 9.

A further modification is shown in FIG. 16, and comprises a variation of the stacks of containers 114 and 214 shown in FIGS. 9 and 14. In FIG. 16, there is shown a stack 314 which comprises three rows of containers, and each row consists of two of the containers 212, and one of the containers 112.

The securing assembly 16 is shown in broken lines in FIG. 16 so that the top row of containers can be seen.

One of the straps 18 extends from the securing assembly 16 over the gap between the adjacent containers 112 and 212. The securing member 22 thereon engages the cooperating formations 128 and the corners of the adjacent containers 112 and 212 in the lower row of the stack 314, thereby holding the lower row of containers 112, 112 together.

The other of the straps 18 extends over the containers 112 to the lower most containers 112 to engage the cooperating formations 28A midway along one of the lower edges of the container 112, the same way as shown in FIG. 9.

Figure 17:
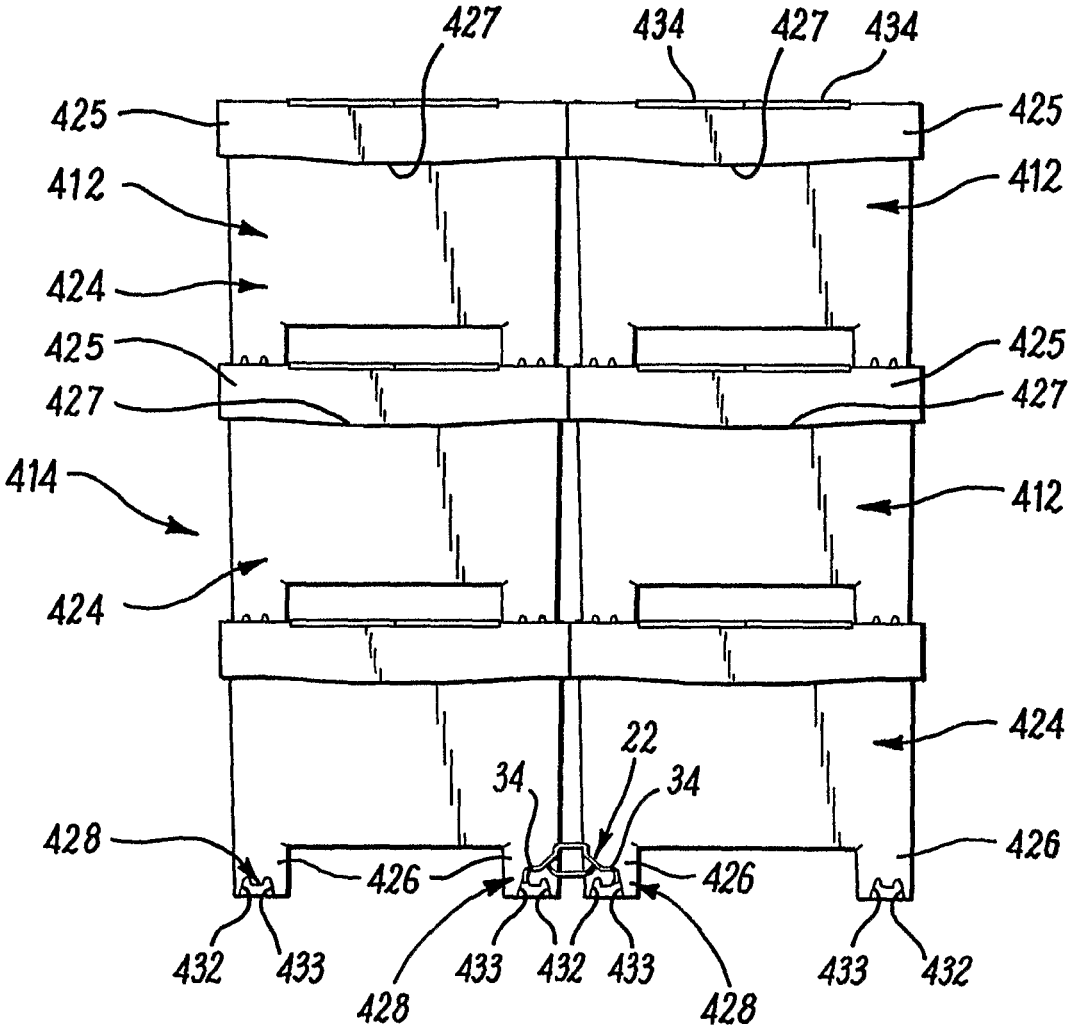
FIG. 17 is a front view of a further embodiment of a load securing system, showing the containers in a stacked condition.
Figure 18:
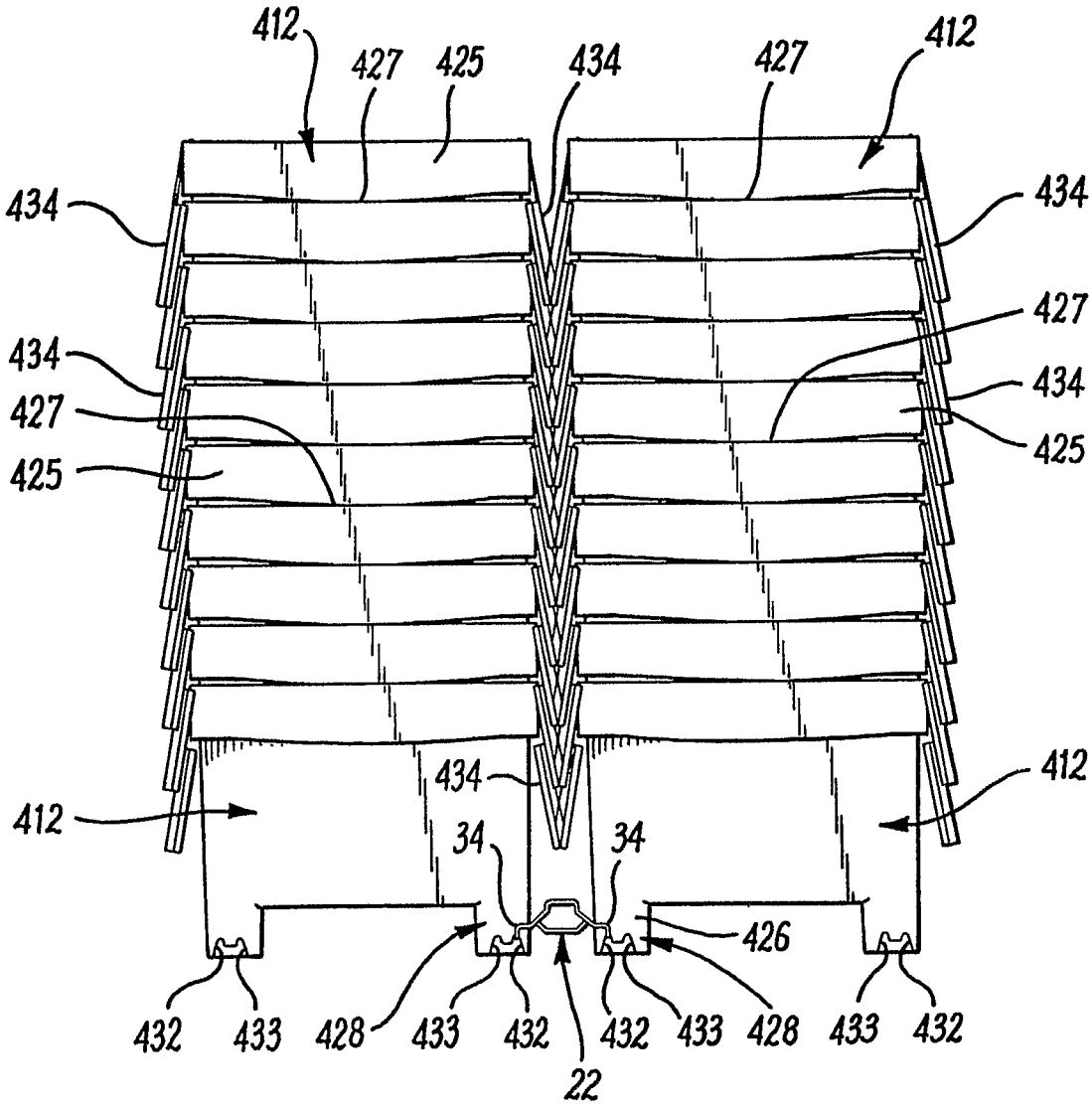
FIG. 18 is a front view of the containers of the embodiment shown in FIG. 17, in a nested condition.
Figure 19:
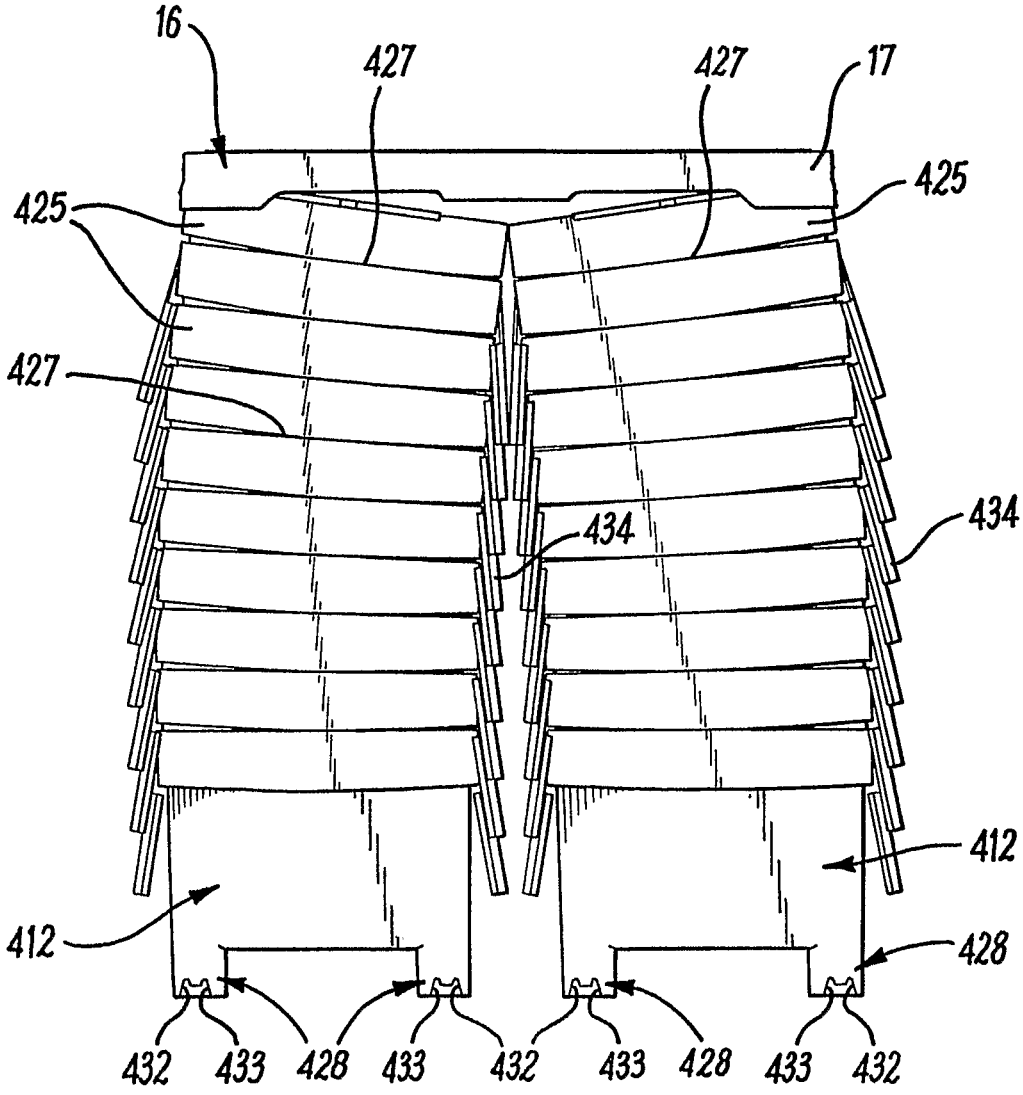
FIG. 19 shows the nested containers of FIG. 18 secured in a load securing arrangement.

Reference is now made to FIGS. 17, 18 and 19 which show a further modification using containers 412. In FIG. 17, the containers 412 are arranged in a stack 414. The securing assembly (with the exception of one of the securing members 22) is not shown for reasons of clarity.

Each container 412 comprises a main body 424 and downwardly extending support members 426 at the corners of the main body 424. A tilting means is provided to tilt the containers 412 to allow the containers to be secured together when nested. The tilting means comprises a downwardly extending lip member 425, which extends from the top of the main body 424. The tilting means further comprises a downwardly projecting convexly curved portion 427 on the lip member 425, the purpose of which is explained below.

Each of the corner support members 426 is provided with a cooperating formation 428, which defines an outer recess 432, and an inner recess 433. The purpose of the two recesses 432, 433 in each cooperating formation 428 is to allow the securing member 22 to engage the cooperating formation 428 when the support members 426 of the containers are pushed away from each other. This is explained in more detail below with reference to FIG. 18. As can be seen from FIG. 17, the hook members 34 on the securing member 22 engage the inner recess 433 on each of the adjacent cooperating formations 428.

The containers 412 comprise hinged lids 434 which are typically mounted on the edges of the containers 412. The containers 412 can be nested one within the other, as shown in FIG. 18. In this arrangement, as can be seen, the lids 434 extend downwardly adjacent sides of the containers in the stack 414.

The open lids 434 which extend downwardly between adjacent containers 412 push the adjacent containers 412 away from each other. As a result, it is no longer possible for the hook members 34 of the securing members 22 to engage the inner recesses 433 of the adjacent cooperating formations 428. Instead, the increase in the distance between the cooperating formations 428 means that the hook members 34 must now engage the outer recesses 432 of the adjacent cooperating formations 428.

In addition, the increase in spacing of the adjacent containers 412 from each other by the open lids 434 means that the top most adjacent containers 412 in the arrangement shown in FIG. 18 are also spaced from each other by the open lids 434. The nested containers 412 shown in FIG. 18 are arranged so that the downwardly extending curved portion 427 engages the upper edge of the lip member 425 of the container 412 below.

Referring to FIG. 19, it can be seen that the downwardly extending curved portion 427 of each of the lip members 425 on the containers 412 allows the containers 412 to pivot about the downwardly extending curved portion is 427 to bring the upper regions of the topmost containers 412 into engagement with each other so that the securing assembly 16 can now be fitted over them.

The straps 18 can then be extended from the housing 17 so that the securing members 22 can engage the cooperating formations 428 of the lower most containers 412, as shown in FIG. 18.

Figure 20:
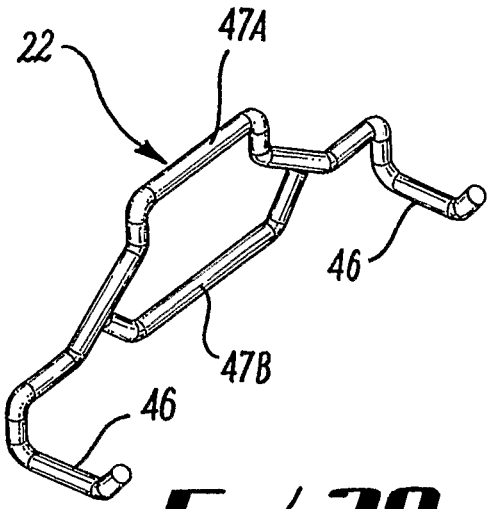
FIGS. 20 to 23 show four different securing members that can be used in the load securing system.

Referring to FIGS. 20 to 23, there are shown four different variations of the securing member 22. FIG. 20 shows the securing member 22 which has already been described above and shown in FIGS. 2 and 5. The securing member 22 shown in FIG. 20 comprises a pair of hooks 46 which are connected to it other by upper and lower bridging portions 46A and 46B.

Figure 21:
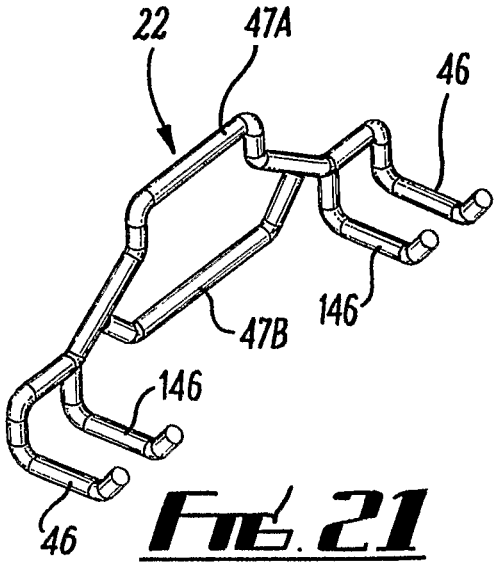

FIG. 21 shows a modification in which, in addition to the hook members 34, the securing member 22 also includes inner hook members 146. The provision of the two sets of hook members 46 146 is useful with the embodiment shown in FIGS. 17, 18 and 19, in which, in FIG. 17, the containers are stacked one on top of the other. The outer hook members 46 engage in the inner recesses 433 of the adjacent cooperating formations 428, and the inner hook members 146 would engage in the outer recesses 432 of the adjacent operating formations 428.

However, where the containers are nested inside one another, as shown in FIGS. 18 and 19, the outer hook members 46 engage in the outer recesses 432, with the inner hook members 146 being arranged between the adjacent cooperating formations 428.

Figure 22:
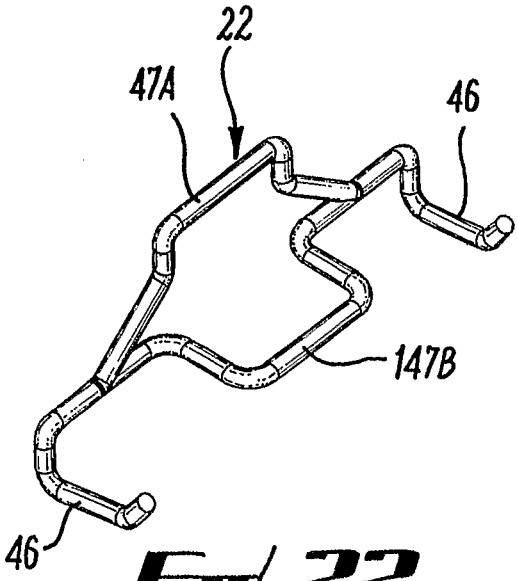

FIG. 22 shows a further modification in which the securing member 22 has only one pair of the hook members 34 and the lower bridging portion 47B is removed and replaced with a spacer member 147B. The purpose of the spacer member 1476 is to provide the correct spacing between the cooperating formations 128 or 428, to allow engagement of the hook members 46 in the recesses 132, or 433. When the securing member 22 is to be engaged with the cooperating formations 128, 428, the spacer member 147B is inserted between the adjacent cooperating formations of adjacent containers 12, 112, 212, 312 or 412

Figure 23:
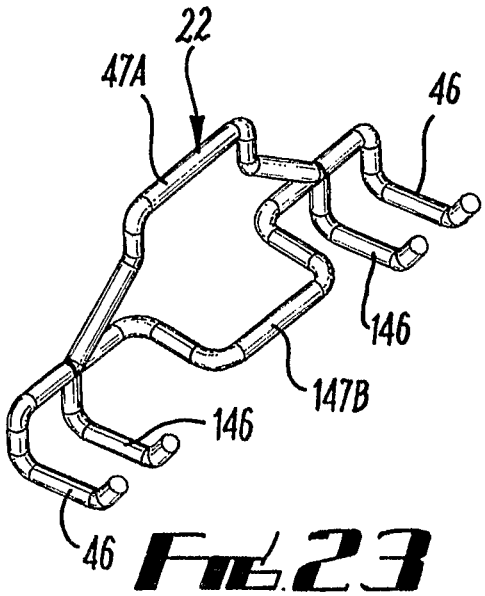

FIG. 23 shows a further embodiment, which is a combination of the features of FIGS. 21 and 22, which comprises inner hook members 146 in addition to the outer hook members 46. The embodiment shown in FIG. 23 also includes the spacer member 147B which has the same function as the spacer member 147B described with reference to FIG. 22.

Various other modifications that can be made to the invention without departing from its scope are listed below.

It will be appreciated that each cooperating formation can be arranged at any suitable position on the main body.

The cooperating formations are described above as comprising a projecting element. Each cooperating formation could be in another form, for example, a recess on a foot, or a recess adjacent an upper edge of the container.

The tensioning device described above is an example of a tensioning device that could be used. It will be appreciated that other tensioning devices could be used in the load securing system.

The containers could be any suitable load carrying structure, such as boxes, crates or similar load carrying packaging.

The above description describes stacks of containers where each row in the stack comprises two, three or four containers. It will be appreciated that any other appropriate arrangement, sizes and numbers of containers can be used in the stacks of containers. Moreover, it is not necessary that each row should have the same number of containers as the others.

In a further modification, the tilting means could be other formations on the main body to allow the aforesaid tilting of the containers relative to each other.

There is thus described and shown herein embodiments of a load securing system that allow a plurality of containers to be secured together for transport or storage without the need of a pallet, thereby reducing costs and storage space.

The above described embodiments therefore provide an advantage over the prior art that the load securing systems enable secure transportation of an array of containers without additional items, such as pallets.

The invention claimed is:

1. A load securing system comprising: a plurality of containers; and a securing device which is configured to secure the plurality of containers together, said plurality of containers comprising first and second containers adjacent each, other in an array of containers, each of said first and second containers comprising a main body, and a plurality of support members extending downwardly from the main body to provide a space beneath the main body, said securing device comprising a plurality of tensioning members, a tensioning device associated with each tensioning member, and a securing member on each of the tensioning members, wherein the securing device is mounted on the containers such that the tensioning members extend from the tensioning devices, wherein each of the securing members is engaged and attached directly to at least one of the containers, and wherein the tensioning devices tension the tensioning members, thereby securing the securing device to the containers and thereby securing the containers to each other.

2. A load securing system as claimed in claim 1, wherein each of the containers comprises at least one cooperating formation which is configured to engage and attach to at least one of the securing members on the tensioning members.

3. A load securing system according to claim 2, wherein each cooperating formation comprises an upper end and a lower end, and is inclined upwardly from the lower end to the upper end.

4. A load securing system according to claim 2, wherein each cooperating formation is arranged adjacent a side corner of the main body, and the cooperating formation is inclined upwardly away from said side corner of the main body.

5. A load securing system according to claim 2, wherein each cooperating formation comprises a recess defined at or adjacent a side corner of the container.

6. A load securing system according to claim 2, wherein each cooperating formation is provided at a distance from the side corner that allows the securing member to extend from the cooperating formation on the first container to the cooperating formation on the second container.

7. A load securing system according to claim 2, wherein each cooperating formation is provided at an upper region of the container, adjacent an upper edge of thereof.

8. A load securing system according to claim 2, wherein each cooperating, formation comprises an inclined engaging edge, and wherein the securing member can engage the engaging edge of the cooperating formation when a plurality of the first and second containers are nested within one another.

9. A load securing system according to claim 8, wherein a further edge extends downwardly from the engaging edge, and an apex of the cooperating formation is defined between the engaging edge and the further edge, and wherein the securing member is configured to engage the apex of the cooperating formation when a plurality of the first and second containers are stacked upon one another.

10. A load securing system according to claim 2, wherein the cooperating formation comprises an inverted V-shaped recess.

11. A load securing system according to claim 2, wherein each container comprises a plurality of cooperating formations, at least one respective cooperating formation being provided at each side corner.

12. A load securing system according to claim 2, wherein the container comprises further cooperating formations to co-operate with further securing members.

13. A load securing system according to claim 12, wherein the further cooperating formations comprise stabilising formations which can cooperate with the further securing members to stabilise the securing assembly, the stabilising formations being provided at positions between the side corners of the containers.

14. A load securing system according to claim 13, wherein the stabilising formations comprise stabilising recesses, provided at lower regions of the container.

15. A load securing system according to claim 13, wherein the stabilising formations comprise inverted V-shaped recesses.

16. A load securing system according to claim 1, wherein the main, body of each container comprises a base having a generally rectangular configuration, and wherein a corner support member is provided at each corner of the base.

17. A load securing, system according to claim 1, wherein a respective intermediate support member is provided in a central region of at least two of the lower edges of the main body, said edges being opposite each other.

18. A load securing system as claimed in claim 1, wherein the securing device comprises a housing, and the tensioning devices are disposed in the housing and mounted on top of the containers.

19. A method of using a securing device to secure a plurality of containers together, said method comprising: providing said plurality of containers, said containers comprising first and second containers adjacent each other in an array of containers, each of said first and second containers comprising a main body, and a plurality of support members extending downwardly from the main body to provide a space beneath the main body; providing said securing device, said securing device comprising a plurality of tensioning members, a tensioning device associated with each tensioning member, and a securing member on each of the tensioning members; mounting the securing device on the containers such that the tensioning members extend from the tensioning devices; engaging and attaching each of the securing members directly to at least one of the containers; and using the tensioning devices to tension the tensioning members, thereby securing the securing device to the containers and thereby securing the containers to each other.

* * * * *